United States Patent [19]

Dunstan

[11] 4,240,537

[45] Dec. 23, 1980

[54] ACCELERATING AND DECELERATING HANDRAIL

[75] Inventor: Phillip E. Dunstan, Seattle, Wash.

[73] Assignee: The Boeing Company, Seattle, Wash.

[21] Appl. No.: 897,263

[22] Filed: Apr. 18, 1978

[51] Int. Cl.[3] ..... B66B 9/12

[52] U.S. Cl. ..... 198/334; 198/792

[58] Field of Search ..... 198/334, 792, 335; 104/25

[56] References Cited

U.S. PATENT DOCUMENTS

| | | | |
|---|---|---|---|
| 3,714,902 | 2/1973 | Zuppiger | 198/334 |
| 3,884,152 | 5/1975 | Emeriat | 198/334 |
| 4,053,044 | 10/1977 | Patin | 198/334 |
| 4,066,161 | 1/1978 | Michalon et al. | 198/334 |

FOREIGN PATENT DOCUMENTS

| | | | |
|---|---|---|---|
| 2343425 | 3/1975 | Fed. Rep. of Germany | 198/792 |

OTHER PUBLICATIONS

"High Speed Moving Walkway," Pamphlet by Boeing Aerospace Company.

*Primary Examiner*—Joseph E. Valenza

*Attorney, Agent, or Firm*—Christensen, O'Connor, Johnson & Kindness

[57] ABSTRACT

A handrail having accelerating and decelerating regions whereat people board and alight from an accelerating and decelerating walkway is disclosed. The handrail comprises a plurality of overlapping handrail elements. The elements move in a vertical, oval track having lengthy sides joined by curved ends. Acceleration of the handrail is synchronized with the acceleration of the moving walkway, and occurs immediately subsequent to the entry of people on the moving walkway. Deceleration of the handrail is synchronized with the deceleration of the moving walkway, and occurs just prior to the exit of people from the moving walkway. Pairs of adjacent overlapping handrail elements are operably connected together by an extendable and retractable member. Each extendable and retractable member is also connected to a cam follower. The cam followers follow acceleration and deceleration cams located internal to the vertical, oval track that defines the handrail path of travel. Through the extendable and retractable member, cam action causes the amount of handrail element overlap to increase or decrease to create deceleration or acceleration, respectively.

13 Claims, 13 Drawing Figures

68
51
43
68
43
43
68
45
59
123
47
57
59
123
57
61
61'
61'''
61''''
123
61
123
123
49
A
B
C
D
α

ACCELERATING AND DECELERATING HANDRAIL

BACKGROUND OF THE INVENTION

This invention is directed to handrails for moving walkways, and more particularly, to variable speed handrails.

Prior art variable speed handrails have been unsatisfactory for use in certain environments. For example, they have been found to be unsuitable for use with an accelerating and decelerating moving walkway such as the one disclosed in U.S. Pat. No. 3,939,959, entitled "Accelerating and Decelerating Moving Walkway," by Phillip E. Dunstan et al., because they have not had the ability to accelerate and decelerate by an amount corresponding to the amount of acceleration and deceleration of such a walkway. Prior art handrails are also more complicated than desired. For example, the prior art overlapping handrail system described in U.S. Pat. No. 3,714,902 entitled "Conveyor Handrails" uses a total of three cams and cam followers and a series of hinged linking arms. Rigid members connect each overlapping handrail platform with the linking arms to provide a small increase or decrease in overlap between adjacent platforms. Additionally, a change of orientation of each platform is required when platform overlap increases or decreases. The multiplicity of components required by this and other prior art handrails to create limited acceleration and deceleration of the handrail make these prior art handrails more complicated than desired. This disadvantage becomes even more objectionable as the length of the handrail increases between the entry and exit regions, because a corresponding increase in the number of components is required. Because each complex handrail platform assembly has a potential for mechanism breakdown, increasing the overall length of the handrail and, thus, the number of components increases the potential for handrail failure. In other words, the mean time between failure decreases with length, which decrease is amplified by the complexity of the individual subsystems. Therefore, these systems are not suitable for use over extended distances.

Additionally, it is often desired to place accelerating and decelerating moving walkways and their related accelerating and decelerating handrails in existing building corridors, such as the corridors of an airport terminal, without modifying the corridors. To accomplish this result, it is necessary that the vertical silhouette of the handrail be relatively low and the horizontal silhouette be relatively narrow. In general, prior art handrails cannot meet this requirement. For example, the overlapping handrail described in U.S. Pat. No. 3,714,902, noted above, requires a large area to reverse the direction of the handrail platforms because of the relationship between adjacent rigid members and linking arms. These components interfere with each other unless a large vertical area is provided for reversing the direction of the handrail. As a result, installation of such a prior art handrail in an existing corridor would require that the corridor be modified by excavating a sufficient area to allow the handrail to reverse directions, if the handrail is to have a convenient height for passengers.

Other prior art handrails achieve acceleration and deceleration by a mechanism that is horizontally oriented. The horizontal orientation of these mechanisms create a handrail having a wide horizontal silhouette.

This prevents these prior art handrails from being used with moving walkways in existing narrow corridors.

Therefore, it is an object of this invention to provide a new and improved variable speed handrail.

It is a further object of this invention to provide a new and improved variable speed handrail having acceleration and deceleration regions capable of being synchronized with the acceleration and deceleration regions of a moving walkway, such as the moving walkway described in U.S. Pat. No. 3,939,959.

It is yet another object of this invention to provide a new and improved accelerating and decelerating handrail that is relatively uncomplicated and, therefore, suitable for use over extended distances.

It is still another object of this invention to provide a new and improved accelerating and decelerating handrail that is low enough and narrow enough for it to be used with a moving walkway installed in existing corridors.

SUMMARY OF THE INVENTION

In accordance with this invention, an accelerating and decelerating handrail suitable for use with an accelerating and decelerating moving walkway is provided. The handrail comprises a plurality of flexible, overlapping handrail elements, which are moved by a drive unit, in a vertical, oval path of travel. Adjacent handrail elements are operably connected together by an extendable and retractable member. The extension and retraction of the extendable and retractable member between adjacent handrail elements is controlled by a cam mechanism located inside of the vertical, oval path of travel. During acceleration the cam mechanism controls the position of the extendable and retractable-member such that element overlap is decreased. During deceleration the cam mechanism controls the position of the extendable and retractable member such that element overlap is increased.

In accordance with further aspects of this invention, the plurality of overlapping handrail elements include a plurality of first and second adjacent elements. The cam mechanism includes: cam rails converging toward and diverging away from the vertical, oval path of travel in the accelerating and decelerating zones, respectively; and, cam follower arms rotatably mounted on each of the plurality of first handrail elements and adapted to follow the cam rails. As the cam follower arms follow the cam rails, they rotate toward and away from the plurality of handrail elements. The extendable and retractable member includes first and second chain or cable sections. The ends of each first chain or cable section are attached to a cam follower arm and a first handrail element. The ends of each second chain or cable section are attached to the same cam follower arm and the next preceding first handrail element. Both the first and second chain or cable sections pass about a sheave assembly mounted on each of the second handrail elements. When cam follower rotation occurs, the length of the plurality of first and second chain or cable sections, running between the plurality of first handrail elements and the sheave assemblies mounted on the plurality of second handrail elements, increases and decreases to cause the desired decrease or increase in element overlap.

In accordance with still further aspects of this invention the amount of element overlap can vary by a factor of ten, whereby the handrail speed factor can vary by ten. Consequently, for a boarding and alighting speed of 1.5 mph the maximum handrail speed can be as high as 15 mph.

In accordance with still further aspects of this invention, the oval path of travel consists of two parallel, horizontal sides joined by boarding and alighting curved ends. The cam rails in the boarding and alighting curved ends have a parallel section and a semicircular section oriented such that a substantial portion of the semicircular cam section is above the longitudinal, horizontal axis defined by the vertical, oval path of travel in the boarding curved end and is below this longitudinal, horizontal axis in the alighting curved end. The semicircular sections of the cam rail are formed in this manner so that the cam follower arms can follow the cam rails without interfering with each other. This permits the handrail to assume a low vertical silhouette.

In accordance with still further aspects of this invention, a mechanism is provided that prevents movement of the handrail elements in an outward direction from the element path of travel. Therefore, adjacent handrail elements cannot be forced away from one another and remain substantially horizontally oriented in both parallel sides.

It will be appreciated from the foregoing brief summary that the invention provides a new and improved accelerating and decelerating handrail. The invention is relatively uncomplicated because it merely requires a suitable track, handrail elements, a single cam mechanism, means to connect adjacent elements and a drive means. Therefore, the handrail may be used with a moving walkway between points separated up to several miles. The handrail occupies minimal horizontal and vertical space and therefore is readily installed with an accelerating and decelerating moving walkway within existing corridors.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein.

DESCRIPTION OF THE PREFERRED EMBODIMENT

Prior to describing a moving handrail formed in accordance with the invention, a brief discussion of an accelerating and decelerating moving walkway with which such a moving handrail is useful is described. In this regard, attention is directed to U.S. Pat. No. 3,939,959, noted above, for a more detailed discussion of the type of accelerating and decelerating moving walkway herein described.

Figure 1:
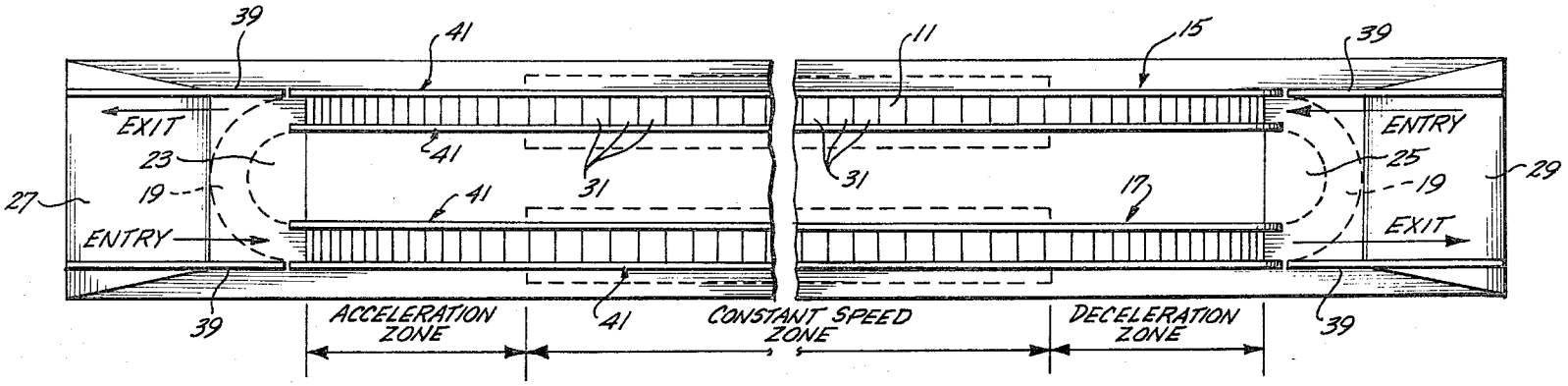
FIG. 1 is a top plan view of an accelerating and decelerating moving walkway including overlapping platforms and accelerating and decelerating handrails.
Figure 2:
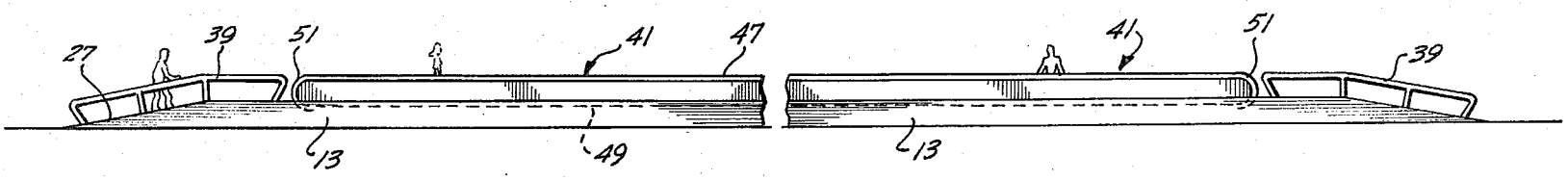
FIG. 2 is a side elevation view of the accelerating and decelerating moving walkway and handrails illustrated in FIG. 1.

The moving walkway illustrated in FIGS. 1 and 2 comprises a plurality of platforms 31 which move in an oval, substantially horizontal planar track 11 formed in a housing 13. The oval, substantially horizontal planar track includes two parallel sides 15 and 17 connected by curved platform turnaround regions 19 and 21. The curved platform turnaround regions 19 and 21 are covered by covers 23 and 25 that form a part of the housing 13. Short ramps 27 and 29 lead up to and down from the covers 23 and 25. Each parallel side 15 and 17 is broken into three zones—an acceleration zone; a constant speed zone; and a deceleration zone. The platforms move through these zones from left to right for the lower side 17, as viewed in FIG. 1 and vice versa (i.e., right to left) for the upper side 15, also as viewed in FIG. 1.

Each end of the moving walkway illustrated in FIGS. 1 and 2 includes an entry region and an exit region. Entry is into the acceleration zones and exit is from the deceleration zones. Thus, people desiring to use the walkway illustrated in FIG. 1 (or freight to be transported by the walkway) enter the side 17 of the oval track, illustrated in the lower portion of FIG. 1, from the left and exit from the right side and vice versa for the other side 15—as illustrated by the entry and exit arrows.

Preferably accelerating and decelerating handrails 41, formed in accordance with this invention, are housed in balustrades located along both edges of both of the parallel sides 15 and 17 of the walkway oval track 11. In addition, side handrails 39, located on either side of the ramps 27 and 29, and the covers 23 and 25, may be included if desired. The side handrails may align with the accelerating and decelerating handrails.

The preferred embodiment of an accelerating and decelerating handrail formed in accordance with this invention generally comprises: a plurality of handrail assemblies; a vertical, oval track; a cam; cam followers; extendable and retractable members; and one or more drive units.

Before proceeding to a detailed discussion of the preferred embodiment, a brief overview is presented without reference to the Figures. The handrail assemblies include: overlapping handrail elements and wheels mounted on the handrail elements. The trailing ends of each handrail element overlap the leading ends of the following element and the wheels are mounted on the leading edges of the inner surface of the handrail elements. The handrail assemblies ride on the vertical, oval track. The cam followers are elongate elements rotatively mounted at one end on alternate handrail assemblies so that the end of the cam follower mechanism remote from the handrail assembly interacts with the cam, which is located inside of the track. The extendable and retractable members operably connect adjacent handrail assemblies and are attached to the cam followers. The drive unit(s) is coupled to the handrail assemblies so as to push the handrail assemblies about the vertical, oval track.

Acceleration and deceleration of the handrail assemblies is synchronized with a moving walkway and is controlled by a change in the amount of handrail element overlap. The amount of element overlap is, in turn, controlled by the unique cooperation of the extendable and retractable members, the cam and the cam followers as the elements are moved about the track by the drive unit(s).

Figure 3:
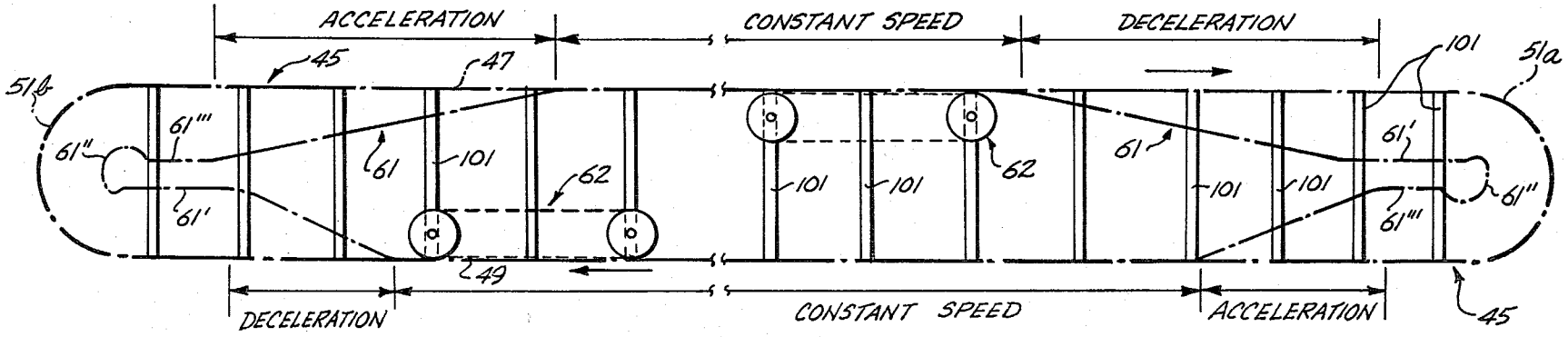
FIG. 3 is a diagrammatic side elevation view of the preferred embodiment of the invention illustrating the shape of the cam and track, and the position of the drive units.

Referring now to FIG. 3, the vertical, oval track 45 incliudes two parallel sides, exposed side 47 and hidden side 49, connected by curved end regions 51. (Exposed side 47 is parallel with, and at a convenient height above, a moving walkway.) The hidden side 49 and the lower portion of the curved end regions 51 are covered by the housing 13. Each parallel side 47 and 49, is broken into three zones—an acceleration zone; a constant speed zone; and a deceleration zone (see FIG. 3). The three zones on the exposed side 47 of the handrail are synchronized with the acceleration, constant speed and deceleration zones of the moving walkway, illustrated in FIGS. 1 and 2.

Handrail Assemblies

Each handrail element 43 has constant cross-sectional dimensions from the front edge to adjacent the rear edge and is shaped so that passengers may grip and hold onto the elements. (As used herein, the terms "front edge" and "rear edge" relate to the illustrated direction of movement of the handrail elements.) When viewed in cross section (FIG. 7), the outer surface of each handrail element 43 has three sections—a central section 63, sloping sections 65 and retaining edge sections 67. The central section 63 is horizontally planar. The sloping sections 65 slope downwardly and outwardly from the central section. The retaining edge sections 67 are horizontally planar and extend outwardly from the sloping sections 65. All three sections are integral with one another. The inner surface of each handrail element 43 parallels the outer surface.

Figure 5:
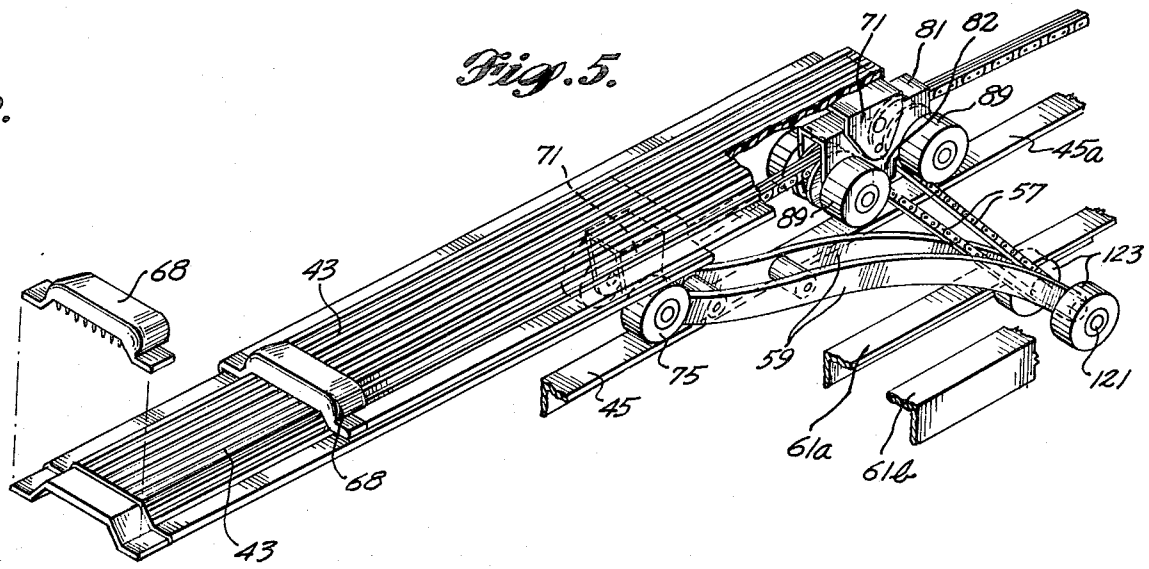
FIG. 5 is a perspective view, partially broken away, illustrating a portion of the preferred embodiment of the invention.
Figure 10:
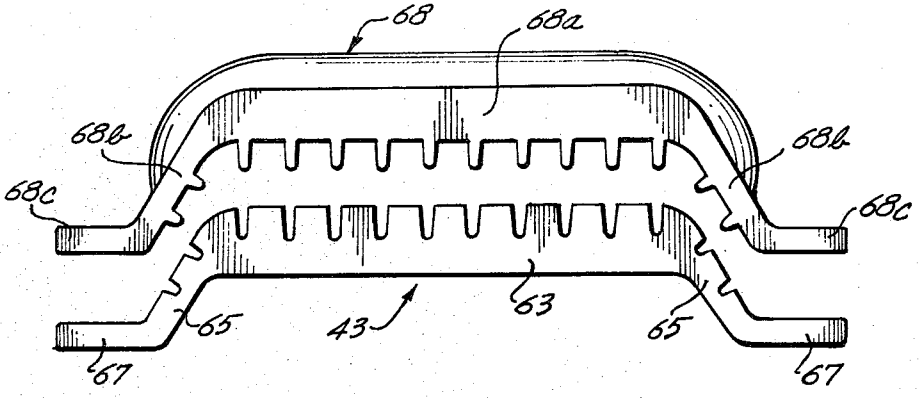
FIG. 10 is an end view of a comb block, positioned above a handrail element with which the comb block intermeshes.
Figure 6:
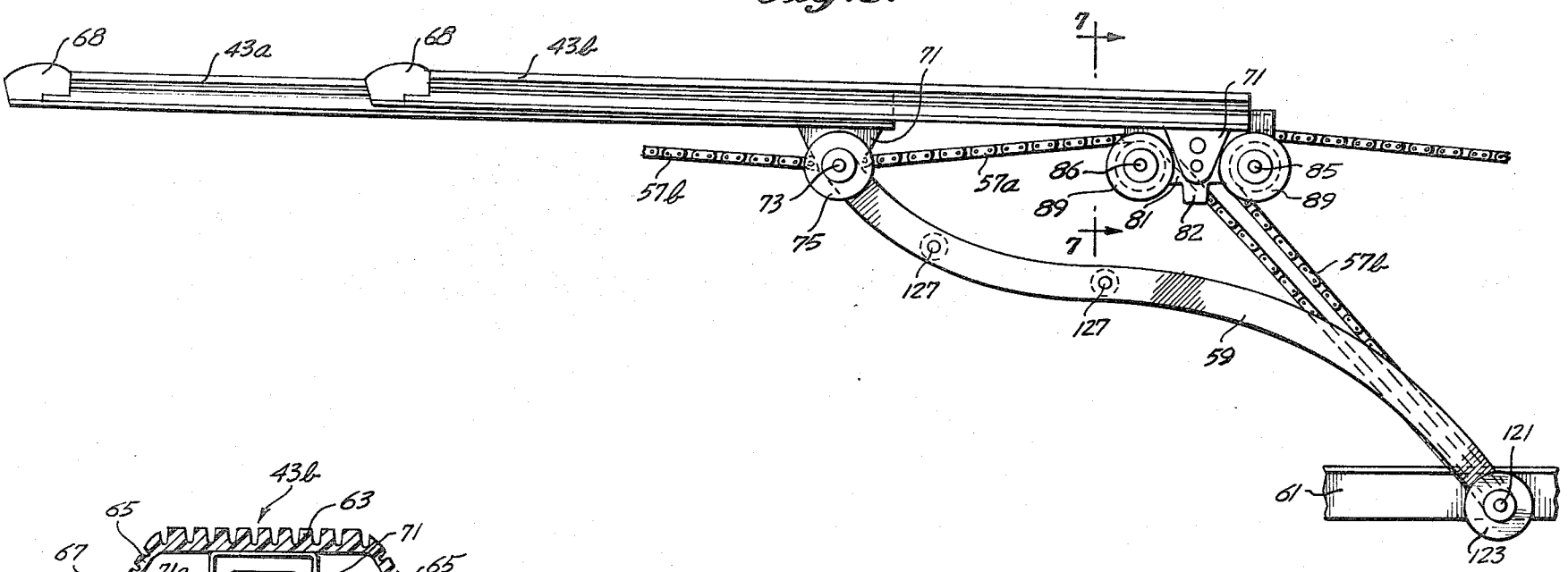
FIG. 6 is an enlarged side elevation view of two adjacent handrail elements and their associated apparatus.

Preferably, as illustrated in FIGS. 5, 6 and 10, the central section 63 and sloping section 65 of the outer surface of the handrail elements 43 are comb-like, i.e., they include a plurality of parallel raised members or "teeth" arrayed in side-by-side relationship. A comb block 68 is attached to a cutaway portion of the outer surface of the handrail element adjacent the rear edge. The comb block 68 has an extension which projects rearward from each handrail element 43. This rearward extension of the comb block 68 has a shape identical to the shape of the handrail elements 43. More specifically, the rearward extension of the comb block 68 has a central section **68*a*, sloping sections 68*b* and retaining edge sections 68*c* of the same dimensions as the respective sections on the handrail elements 43. The inner surface of the central and sloping sections 68*a* and 68*b* of the rearward extension of the comb block 68 is combed and meshes with the combs formed in the central and sloping sections 63 and 65 of the outer surface of the adjacent succeeding handrail element 43. The comb block 68, therefore, prevents objects or fingers from being pinched as the amount of handrail element overlap increases or decreases, and maintains lateral alignment of the handrail elements as they move about the vertical, oval track 45. Preferably, the joining surfaces of the comb block 68 and the upper surface of the handrail elements 43 are as friction-free as possible. For example, they may be coated with Teflon. Moreover, the elements 43 are made of flexible, antifriction material so that they can: (1) resiliently bend as they move through the curved end regions 51** and remain in continuous contact with adjacent elements; and (2) freely slide on one another.

Referring now to FIGS. 5–9, a first bracket 71 is centrally mounted on the inner surface of each handrail element 43 slightly rearwardly of the front edge. The bracket 71 is U-shaped in cross section and inverted so that flanges **71*a* project orthogonally inwardly from the central section 63 of the inner surface of each handrail element 43. See FIG. 7. As illustrated in FIG. 6, different apparatus are attached to or associated with the first bracket 71 on adjacent elements 43, so that the elements can move about the curved end regions 51 without internal interference. For purposes of describing the preferred embodiment of this invention, adjacent handrail elements will be designated a first handrail element 43*a* and a second handrail element 43*b*. The flanges 71*a* of the first bracket 71 on the first handrail element 43*a* support an axle 73 having a longitudinal axis transverse to the direction of travel of the handrail elements. A pair of wheels 75 are mounted for rotation on the axle 73 so as to lie beyond the outer surfaces of the flanges 71*a* of the first bracket 71. The pair of wheels 75 support the front edges of the first handrail element 43*a***.

A second bracket 81 is rotatably mounted on a pin 83 passing through the flanges **71*a* of the first bracket 71 mounted on the second handrail element 43*b*. The pin 83 is supported by and attached to the flanges 71*a* of the first bracket 71 and has a longitudinal axis that is transverse to the path of travel of the handrail elements. Therefore, the second bracket 81 is allowed to move about the pin 83, which acts as a fulcrum, independent from the movement of the handrail element. This feature is important when the handrail elements 43 move through the curved end regions 51. An extendable and retractable member 57 (explained below) acts upon the second bracket 81 in a plurality of directions in the curved end regions 51**.

Figure 7:
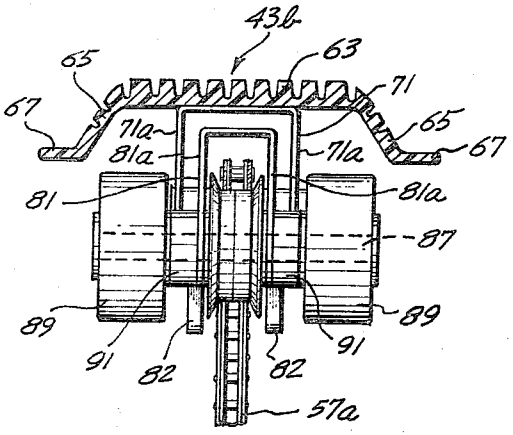
FIG. 7 is a cross-sectional view of a handrail element, and its associated apparatus, taken along line 7—7 of FIG. 6, formed in accordance with the invention.

The second bracket 81 has an inverted U-shape in cross section, as shown in FIG. 7, and has a rectangular shape when seen in a side elevation view, illustrated in FIG. 6. The inwardly projecting flanges **81*a* of the second bracket 81 support forward and rearward axles 85 and 86, each having a longitudinal axis that is transverse to the path of travel of the handrail elements. The forward axle 85 is mounted slightly rearwardly of the front edge of the second bracket 81. The rearward axle 86 is mounted slightly forwardly of the rearward edge of the second bracket 81. Pairs of wheels 89 are mounted on the forward and rearward axles so as to lie beyond spacer washers 91 that are adjacent to the outer surface of the flanges 81***a* of the second bracket 81. The two pair of wheels 89 support the front edges of the second handrail element 43*b*. The forward axle 85 and rearward axle 86 are so mounted on the second bracket 81, and the second bracket is so mounted on the pin 83, that the average distance between the axles 85 and 86 and the inner surface of the second handrail element 43*b* is generally the same as the distance between the axle 73 and the inner surface of the first handrail element 43*a*. Further, all of the wheels 75 and 89 have the same diameter. The transverse distance between the pair of wheels 75 mounted on the first handrail element 43*a* is the same as the transverse distance between the two pairs of wheels 89 mounted on the second handrail element 43*b*.

The flanges 81*a* of the second wheel bracket 81 are also provided with cam follower spacer flanges 82. The cam follower spacer flanges 82 are integral with and project inwardly from the flanges 81*a* of the second wheel bracket 81, and are centrally located below the pin 83. In the constant speed zone of the exposed side 47 the cam follower spacer flanges 82 abut against the outer surface of the cam follower arms 59 (described below) and lift the wheels 89 so that the wheels 89 do contact the track 45. By reducing wheel contact in this manner, the useful life of the wheels 89 is increased.

The Track

Figure 8:
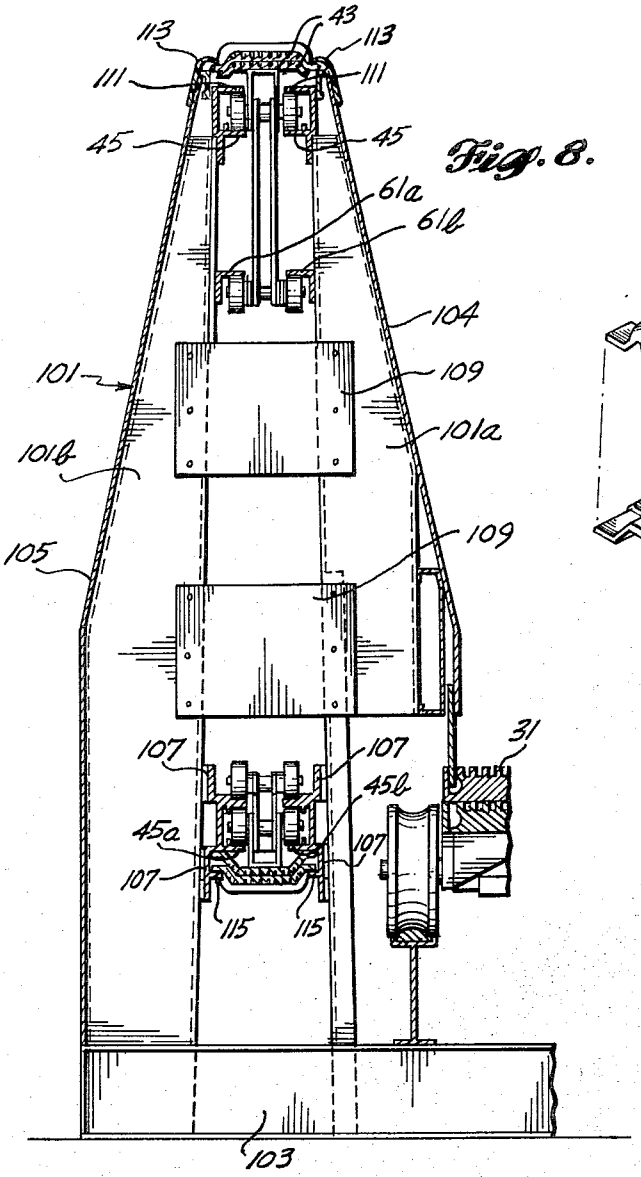
FIG. 8 is a cross-sectional view of a supporting balustrade.

The plurality of the pairs of wheels 75 and 89 are arrayed on the track 45. (The track consists of a parallel pair of track rails 45*a* and 45*b*.) As shown by FIG. 3, the track 45 forms a continuous, vertically oriented oval, which defines the continuous path of travel of the handrail elements 43. Referring now to FIG. 8, the track rails 45*a* and 45*b* are channels, U-shaped in cross section and rotated 90° so that their openings face one another. The track 45 is affixed to a series of vertically oriented ribs 101 which form part of the balustrade of the handrail. Each rib 101 includes an inner member 101*a* and an outer member 101*b*, which project upwardly at right-angles from and are affixed to a suitable base member 103. The inner member 101*a* is adjacent to the platforms 31 of the moving walkway and supports a protective cover 104, which shields the passengers on the walkway from the apparatus associated with the moving handrail. The outer member 101*b* is spaced away from the inner member 101*a* in a direction transverse to the path of travel of the handrail elements 43, and supports a protective cover 105, which is a part of the external housing 13. The spaced relation between the inner and outer members 101*a* and 101*b* on the exposed side 47 of the track is generally dictated by the transverse distance between the outer surfaces of the plurality of pairs of wheels attached to the handrail elements. Contrariwise, on the hidden side 49, the entire handrail element 43 must be accommodated between the inner and outer members 101*a* and 101*b*. Because the spaced relationship on the hidden side is greater (the retaining edge sections 67 extend beyond the outer surfaces of the pairs of wheels 75 and 89), the inner and outer members 101*a* and 101*b* converge toward one another in the vertical direction as they extend upwardly from the base member 103. To compensate for this dimensional difference and to align the pair of track rails 45*a* and 45*b* on the hidden side 49 with the plurality of wheels of the handrail elements 43, the track rails 45*a* and 45*b* are connected to the members 101*a* and 101*b* by spacer support structures 107 on the hidden side. Additionally, at least one rib supporting plate 109 attaches the inner and outer members 101*a* and 101*b* of the ribs 101 together, between the cams 61 (explained below), so that the desired fixed space relationship between the two members is maintained.

As the handrail element overlap increases in the acceleration and deceleration zones, the stacking of the handrail elements increases the vertical height of the handrail with respect to the vertical level of the handrail elements in the constant speed zone. In order to compensate for this increased handrail height and maintain a substantially horizontally planar surface in the exposed side 47, the track 45 declines downwardly in the acceleration and deceleration zones, from the constant speed zone.

Support Arms

Still referring to FIG. 8, a pair of handrail element support arms 111 are provided just below the inner surface of the handrail elements on the exposed side 47 to support the handrail elements if they are subjected to a large downward force exerted by passengers. The support arms 111 are integral with, and project upwardly from the outer edge of each track rail 45*a* and 45*b*. At a point where the extension lies above the wheels 75 and 89 the support arms 111 project inwardly, up to the area occupied by the first brackets 71.

Handrail Element Antiseparation Mechanism

The overlapping handrail elements 43 are prevented from separating from one another on the exposed side 47 and curved end regions 51 by continuous, arcuately contoured retaining lips 113. See FIG. 8. The retaining lips 113 are attached to the upper section of the protective covers 104 and 105 to the support arms 111, and have extensions, substantially semicircular in cross section, that extend over and surround the retaining edge sections 67 of the upper surface of the handrail elements 43. On the exposed side 47, the ends of the retaining lip 113 are adjacent to, but do not contact, the upper surface of the retaining edge sections 67 of the handrail elements 43. Thus, the retaining lip does not form a frictional resistance to the movement of the elements, yet it protects passengers from getting their hands and fingers pinched by the overlapping elements and prevents the elements from being inadvertently lifted away from one another. In the curved end regions 51, the end of the retaining lips contacts the upper surface of the retaining edge sections 67, to bend and hold together in continuous contact the handrail elements 43 so that a smooth, continuous upper handrail surface is exposed to passengers. In the hidden side 49, the retaining edge sections 67 of the handrail elements 43 are slidably mounted on, and retained against one-another in a horizontal position by retaining flanges 115 orthogonally projecting toward one another from the spacer support structures 107, below the pair of track rails 45*a* and 45*b*.

Cam Follower

Figure 9:
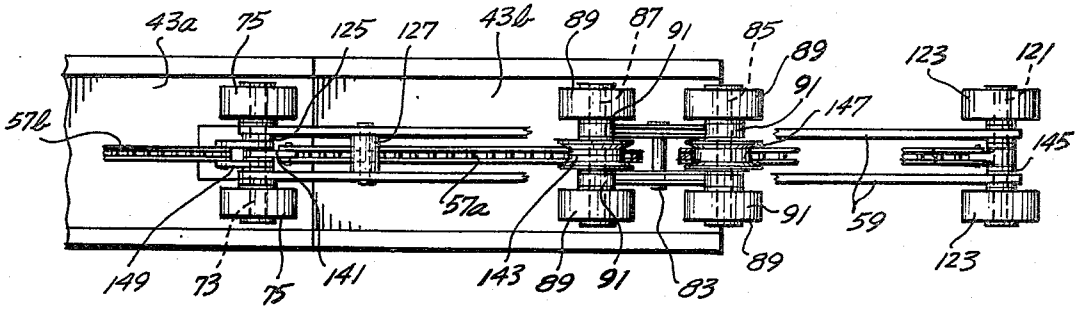
FIG. 9 is an enlarged bottom plan view of the two handrail elements and associated apparatus shown in FIG. 6.

As illustrated by FIGS. 5, 6 and 9, one end of each of a pair of identically-shaped cam follower arms 59 are mounted for rotation on the axle 73 attached to each of the first handrail elements 43*a*. The cam follower arms are mounted so that the outer surface of each cam follower arm is adjacent the inside surfaces of the flanges 71*a* of bracket 71. The spacing between the outer surfaces of the pair of cam follower arms is less than the space between the track rails 45*a* and 45*b*. Therefore, the pair of cam follower arms 59 can rotate without interference between the track rails 45*a* and 45*b* and cam rails 61*a* and 61*b* (explained below). Additionally, as best viewed in FIG. 4, the cam follower arms 59 have a lazy-S shape that is adapted to avoid interference with adjacent cam follower arms and the apparatus associated with an adjacent second bracket 81, in the curved end regions 51. More specifically, when viewed from the side, as illustrated by FIG. 6, the arms 59 are concavely contoured outwardly and forwardly from the axle 73 of the first handrail element 43*a* to the middle of the cam follower arm; then the arms are convexly contoured inwardly and forwardly. A cam follower axle 121 is mounted on the end of the pair of cam follower arms 59 opposite the first bracket 71, and has a longitudinal axis that is transverse to the path of travel of the handrail elements. A pair of cam follower rollers 123 are mounted for rotation on the cam follower axle 121 adjacent the outer surfaces of the cam follower arms 59. The transverse distance between the pair of cam follower rollers 123 is equal to the transverse distance between the plurality of the pairs of wheels 75 and 89 mounted on the handrail elements. The transverse space relationship between the pair of cam follower arms 59 is maintained by spacer collars 127. The spacer collars 127 are inserted between and attached to the pair of cam follower arms at selected intervals.

Cam

The pair of cam follower rollers 123 are aligned with, and ride on, a cam 61, formed by a pair of elongate cam rails 61*a* and 61*b* mounted inside of the oval track, in the plane of the track. In the constant speed zones of the exposed side 47 and hidden side 49 of the track, the cam rails 61*a* and 61*b* converge into and become formed by the inner surfaces of the track rails 45*a* and 45*b*. In the accelerating and decelerating zones and in the curved end regions 51 the cam rails are formed by a right-angle flange mounted on the inner and outer members 101*a* and 101*b* of the ribs 101, such that one flange is located between the cam follower rollers 123 and the handrail elements 43. Referring to FIG. 3, starting with the entry region of the accelerating zone, the cam 61 converges toward the track 45. Contrariwise, the cam 61 diverges away from the track 45 in the decelerating zone, starting from the constant speed zone.

Particular importance is placed on the shape of the cam 61 adjacent the curved end regions 51. In this regard, the shape of the cam 61 adjacent the alighting curved end region 51*a* is shown in an enlarged side elevation view in FIG. 4. In this region, the cam has three sections—a first parallel section 61', a semicircular section 61'', and a second parallel section 61'''. The first parallel section 61' is located at the end of the exposed side decelerating zone. The cam 61 becomes parallel with and lies above the longitudinal, horizontal axis D defined by the oval-shaped track 45. Therefore, a short, slow, constant speed zone is formed wherein the overlap of the handrail elements 43 is maximum.

The track 45 in the curved end regions 51 is semicircular and has a diameter A that is substantially vertical. However, because the cam follower arms 59 (and thus the cam follower rollers 123) precede the related handrail element 43, the semicircular section 61'' of the cam 61 adjacent to the curved end region cannot follow a path that "tracks" the curved end regions of the track 45. However, the section of the cam 61 adjacent the curved end regions is still semicircular. The difference is that the diameter B of the semicircular cam section 61'' is rotated with respect to the diameter A of the semicircular section of track 45, so that an angle $\alpha$ of approximately 20° is formed between the diameter B and the longitudinal, horizontal axis D defined by the vertical, oval track 45. Thus, a substantial portion of the cam semicircular section 61'' in the alighting curved end region 51*a* is below the longitudinal, horizontal axis D of the oval-shaped track and the cam first parallel section 61' extends past the diameter A of the semicircular section of the track 45. Additionally, the center C of the cam semicircular section 61'' is coincident with the center of the semicircular track 45 in the curved end regions 51.

It should be noted that in some environments it may be necessary to increase the spacing between the components of adjacent handrail elements before changing their direction. For example, just prior to the cam semicircular section 61'', the cam 61 may curve slightly outwardly toward the semicircular section of track 45. As will be explained more fully below, this slight curvature of the cam 61 has the effect of slightly reducing the amount of overlap of the handrail elements 43, and therefore insures adequate space between adjacent cam follower rollers 123, cam follower arms 59, wheels 75 and 89 and brackets 71 and 81 when these elements move through the crowded curved end region 51. In this region, the second parallel section 61''' is located just after the semicircular section 61'' of the cam. The cam 61 is again parallel with, but below, the longitudinal, horizontal axis D of the vertical, oval track 45. Except for the slight decrease of element overlap, explained above, the curved end regions 51 are constant speed zones wherein element overlap remains constant.

Figure 4:
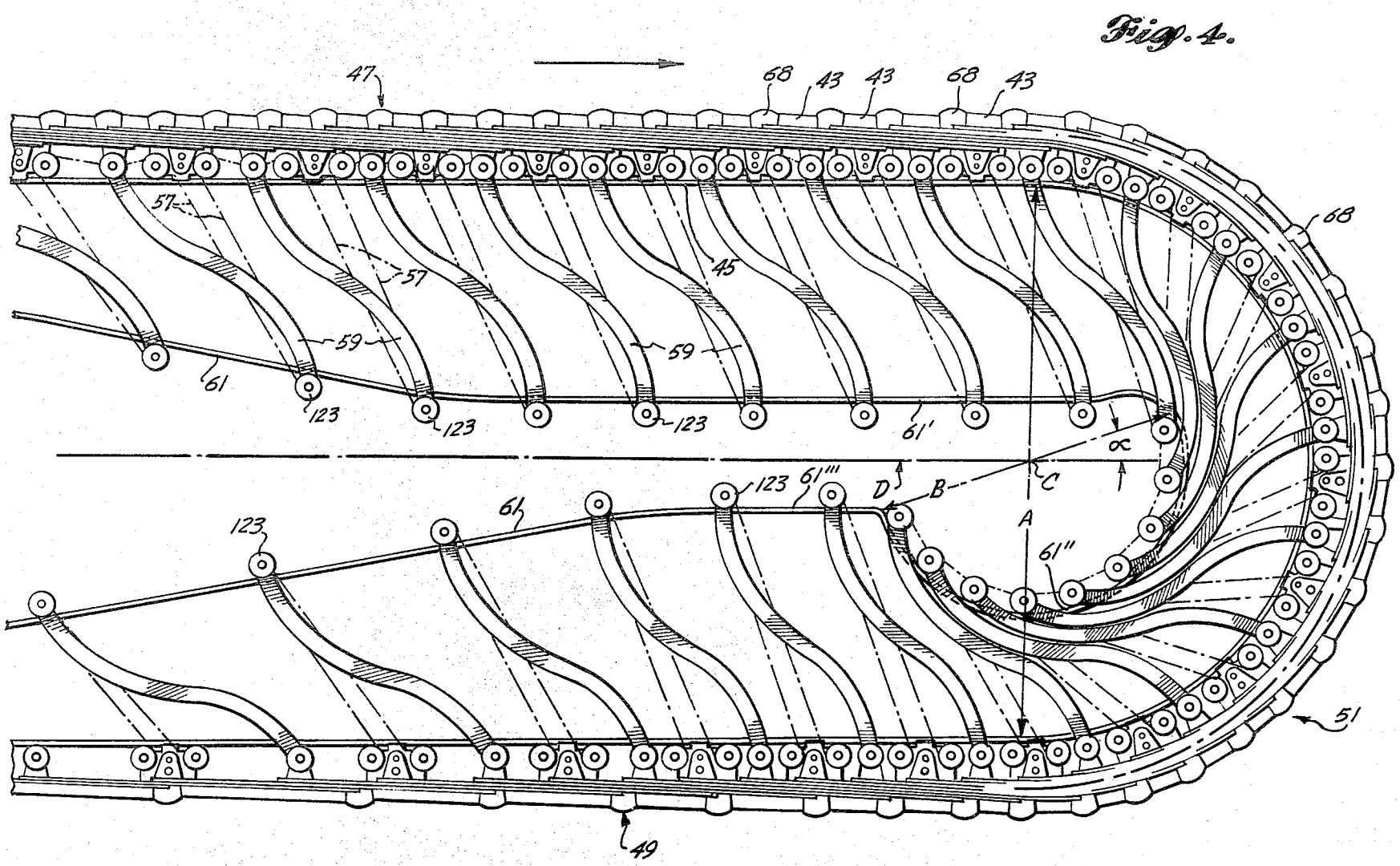
FIG. 4 is a partial side elevation view illustrating the alighting portion of the preferred embodiment of the invention.

At the boarding curved end region 51*b* as shown in FIG. 3, the shape of the cam 61 is exactly the same as the shape of the cam in the alighting curved end region 51*a*, illustrated in FIG. 4, with the exception that the description starts with the hidden side decelerating zone of the handrail rather than the exposed side decelerating zone. Therefore, the cam 61 has parallel sections just after the hidden side decelerating zone and just before the exposed side accelerating zone; and, a semicircular section having a substantial portion lying above the longitudinal, horizontal axis of the vertical, oval track. The center of the semicircular cam section in the boarding curved end 51*b* is coincident with the center of the semicircular track 45.

The acceleration and deceleration of the handrail elements on the exposed side 47 is synchronized with the acceleration and deceleration of the moving walkway with which the handrails are associated. On the hidden side 49, however, the acceleration and deceleration of the handrails is much quicker so that element overlap is quickly reduced to a minimum and the number of handrail elements and associated apparatus needed to form the complete handrail 41 is kept to a minimum.

Extendable and Retractable Member

As illustrated in FIGS. 6 and 9, trios of adjacent handrail elements are operably connected by an extendable and retractable member 57, such as a chain (illustrated) or cable formed of first and second sections 57*a* and 57*b*. The trio includes: two (2) first handrail elements 43*a*; and, one second handrail element 43*b*. Starting with the first handrail element 43*a*, a first extendable and retractable section 57*a* is centrally connected to axle 73, between the yoke 149 of a second extendable and retractable section, by a connecting ring 141. The first extendable and retractable section 57*a* extends forward and passes around a sheave 143 centrally mounted for rotation on the rearward axle 86 of the second handrail element 43*b*. The first extendable and retractable section 57*a* then projects downwardly and forwardly from sheave 143 and is centrally attached to the cam follower axle 121 associated with the same first handrail element 43*a*, between the pair of cam follower arms 59, by connecting collar 145. The second extendable and retractable section 57*b* connects the second handrail element 43*b* with each adjacent preceding first handrail element 43*a*. The second extendable and retractable section 57*b* is centrally attached to the cam follower axle 121 between the pair of cam follower arms 59 on the connecting collar 145, and extends rearwardly and upwardly to pass around a second sheave 147 centrally mounted for rotation on the forward axle 85 of the second handrail element 43*b*. The second extendable and retractable section 57*b* then projects forwardly from the second sheave 147 and is centrally attached to the axle 73 of the next preceding first handrail element 43*a*, between the pair of cam follower arms 59, by a connecting yoke 149.

When the overlapping handrail elements 43 are pushed by a drive unit 151 (explained below) around the vertical, oval track 45, the sections 57*a* and 57*b* of the extendable and retractable member 57 exert a force on the cam follower axles 121 that attempts to rotate the cam follower arms 59 toward the track 45. As the cam follower rollers 123 follow the cam 61, the cam follower arms 59 are moved toward and away from the handrail elements 43, by the cam 61, causing the amount of the extendable and retractable member 57, extending between adjacent handrail elements, to increase and decrease. This extension and retraction of the extendable and retractable member 57 causes the amount of element overlap to decrease and increase respectively. In this manner, handrail element acceleration and deceleration in the acceleration and deceleration zones, whereat the converging and diverging cam are located, occurs.

Preferably, the amount of element overlap, in areas of maximum element overlap such as the beginning of the acceleration zone and the end of the deceleration zone, is ten times greater than the amount of element overlap in areas of minimum overlap, such as the constant speed zones. Therefore, a speed differential of ten (10) exists between the speed of the handrail elements 43 in the constant speed zone and the boarding and alighting speed.

Drive Unit

Figure 11:
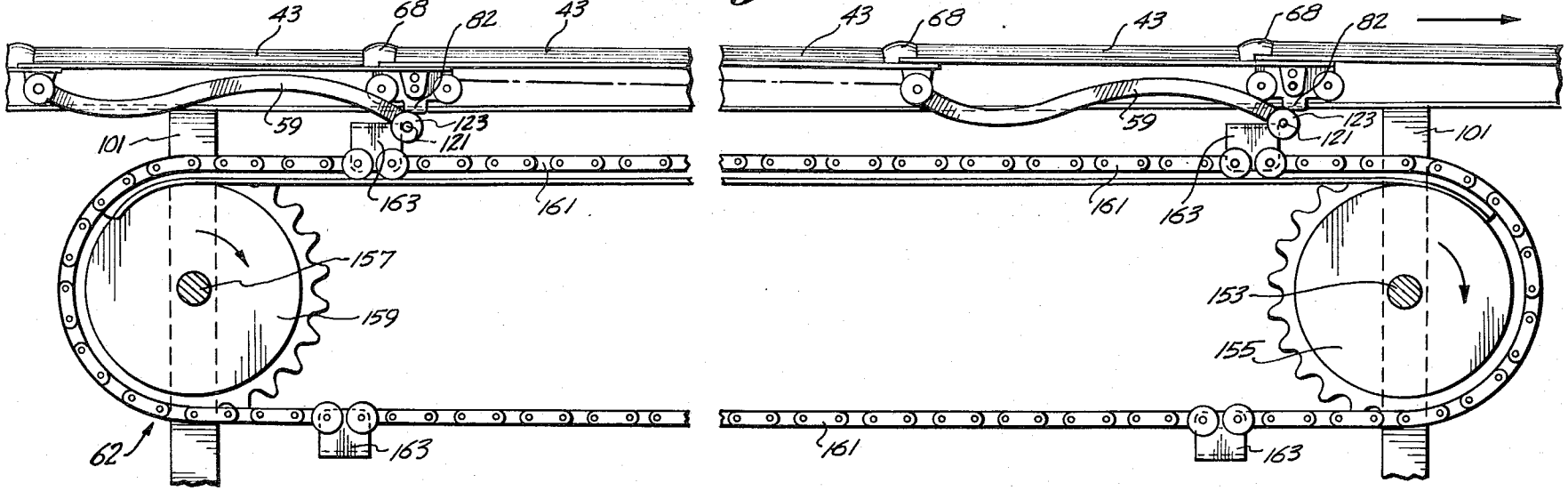
FIG. 11 is a side elevation view of a drive unit suitable for moving handrail elements, formed in accordance with the invention.

A variety of drive units 62 can be utilized to move the handrail elements about the vertical, oval track 45. One such unit is illustrated in FIG. 11 and comprises an electric motor (not shown) adapted, through a gearbox (also not shown), to drive a drive shaft 153. The drive shaft 153 is rotatably mounted within a rib 101 between the two members 101*a* and 101*b*, and is transverse to the path of travel of the handrail elements. Centrally affixed to the shaft is a drive gear 155. An idler shaft 157 lying parallel with the drive shaft 153 is mounted on an adjacent rib. Centrally mounted on the idler shaft 157 is an idler gear 159. A drive chain or belt 161 is mounted on the drive gears 155 and idler gears 159. The drive chain or belt 61, thus, moves through an oval path of travel having two linear, elongate sides. One of these sides is adjacent to, and parallel with the cam, preferably in the constant speed zones adjacent to the deceleration zones, as illustrated best in FIG. 3.

Affixed on the drive chain or belt 161 are outwardly extending drive elements 163. The outwardly extending drive elements 163 coact with the cam follower axle or wheel 121 so that each succeeding outwardly extending drive element 163 contacts a cam follower axle 121. More specifically, the spacing between the drive elements is equal to the spacing between the cam follower axles in the region where the drive units are located. Moreover, the side of the belt or chain adjacent to the cam is close enough for the drive elements to impinge on the cam follower axles or wheels. Thus, each drive element moves a cam follower axle and an associated handrail element 43 until the drive unit is released from the axle 121. In this manner, the elements 43 are constantly moved through the constant speed zone. The undriven elements 43 are, of course, pulled "forward" by the driven elements.

Alternative Handrail Embodiment

Figure 13:
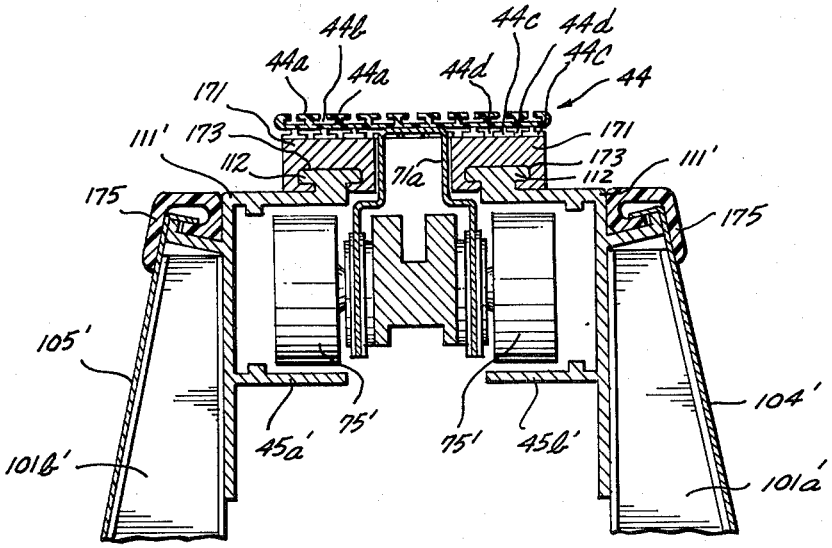
Figure 12:
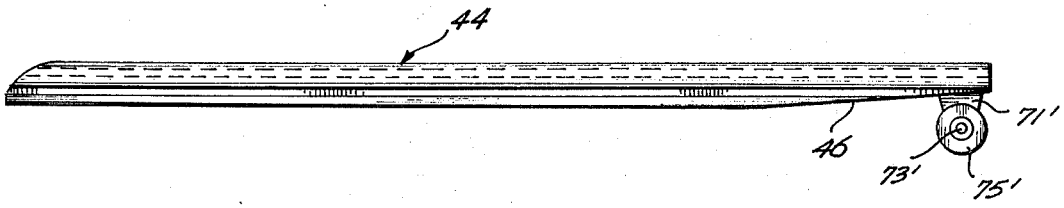
FIG. 12 is a side elevation view of an alternative handrail element formed in accordance with the invention; and, FIG. 13 is a cross-sectional view of a port of a balustrade showing the alternative handrail element illustrated in FIG. 12 and supporting side blocks, protective lip and ribs, all formed in accordance with this invention.

In an alternative embodiment of this invention, as illustrated in FIGS. 12 and 13, adjacent alternative handrail elements 44 are slidably connected in a manner that prevents them from separating from each other in all directions except parallel with the longitudinal axis of the elements, and are supported on the exposed side 47 by slide blocks 171. The functions provided by the support arms, comb block and retaining lip, previously described, are performed in a different manner in the alternative embodiment.

As viewed in FIG. 12, the alternative handrail elements 44 are elongate members and made of friction-reducing, resilient material. Preferably, the length of the handrail elements is such that a thickness of at least two adjacent alternate handrail elements 44 is constantly presented to passengers on the exposed side 47. The upper, rear edge of each alternative handrail element 44 is arcuately contoured to provide a smooth transition between adjacent elements. The bottom surface of each alternative handrail element 44 has a tapered section 46 which inclines outwardly adjacent its front end. Thus, the first wheel bracket 71' can be securely fastened to a planar surface, rather than the inwardly extending comb teeth 44*b* (explained in detail below) of each alternative handrail element 44. More importantly, the tapered section 46 of the bottom surface of each alternative handrail element 44 provides a bearing surface for each element when the element is inclined outwardly and rearwardly due to the stacking of the overlapping elements. The tapered section rides on the slide blocks 171, which substantially eliminates any gaps between the elements and the slide blocks.

Referring now to FIG. 13, the outer surface of each alternative handrail element 44 consists of a plurality of comb teeth 44*a*, "T"-shaped in cross section, and arrayed in side-by-side relationship parallel with the longitudinal axis of each handrail element. The voids 44*b*, which separate the comb teeth, have an inverted "T" shape in cross section. Similarly, the bottom surface of each handrail element has inwardly extending comb teeth 44*c* and voids 44*d* that are identical with the comb teeth and voids of the outer surface with the exception that the downwardly extending comb teeth 44c are offset to be centrally aligned with the voids 44b of the outer surface. Because voids 44b and 44d have slightly larger dimensions than comb teeth 44a and 44c, the comb teeth 44a and 44c on each alternative handrail element 44 and its adjacent handrail elements are slidably mounted within their mutually opposing voids 44b and 44d. This intermeshing of alternative handrail elements maintains the lateral alignment of the handrail elements as they move about their path of travel, and also prevents adjacent alternative handrail elements from being separated by movement of one alternative handrail element in any outward direction.

In at least the exposed side 47 and curved end regions the alternative handrail elements 44 are mounted for substantially friction-free sliding movement on slide blocks 171. Each slide block 171 is an elongate member and is rectangular-shaped in cross section. Its inner surface is affixed to an extension 112 projecting outwardly from the outer surface of each of the track rails 45a and 45b. The extension 112 is "T"-shaped in cross section and fits snuggly with a corresponding "T"-shaped cavity 173 extending through the inner surface of the slide blocks 171. As shown in FIG. 13, one side of each slide block 171 is adjacent the flanges 71a' of the wheel bracket 71' and assists in maintaining lateral alignment of the alternative handrail elements 44 as they move about their vertical, oval path. The opposite side of each slide block 171 is planar with the side surfaces of the alternative handrail elements.

A protective lip 175 covers the outer end of the protective covers 104 and 105 and abuts against the side surface of the track rails 45a and 45b. When viewed in cross section, the outer surface of the protective lip 175 is planar with the outer surface of the track rails 45a and 45b. The combination of the alternative handrail elements 44 and the slide blocks 171 form a convenient, readily grippable surface with which passengers may hold. The height of the slide blocks 171 is regulated so that in the constant speed zone of the exposed side, wheels 75 and 89 are lifted away from and do not contact the track 45; and in the acceleration and deceleration zones and curved end regions, the wheels 75 and 89 are permitted to contact the track 45. Thus, the front end of each alternative handrail element 44 is supported entirely by the slide blocks 171 in the constant speed zone, and is supported by both the slide blocks 171 and the wheels 75 and 89 in the acceleration and deceleration zones and curved end regions. Wear on the wheels 75 and 89 and the noise generated by the handrail are also substantially reduced by avoiding frictional contact between the wheels 75 and 89 and the track 45 in the constant speed zone.

It will be appreciated from the foregoing description that the invention provides a new and improved accelerating and decelerating handrail. Because the handrail has few mechanical components, the mean time between failure is low. As a result a handrail formed in accordance with the invention may be made relatively long without substantially increasing the mean time between failure, when compared with prior art systems that are more complex. Therefore, a handrail formed in accordance with this invention is ideally suitable for use over relatively long distances, such as one-quarter of a mile or greater. Moreover, a handrail formed in accordance with this invention is capable of achieving a greater speed differential than prior art handrails, while maintaining a low vertical silhouette, which allows it to be installed in existing corridors without requiring that the corridors be modified. Furthermore, all of the operable components, except the retaining lip, lie within the width of the vertical, oval path of travel of the handrail elements, whereby the handrail has a thin horizontal silhouette, which also adds to its usefulness in narrow corridors.

While a preferred embodiment of the invention has been illustrated and described, it will be appreciated by those skilled in the art and others that various changes can be made therein without departing from the spirit of the invention. Hence, the invention can be practiced otherwise than as specifically described herein.

The embodiments of the invention in which an exclusive property or privilege is claimed are defined as follows:

1. An accelerating and decelerating handrail comprising:

(1) a path of travel defining means for defining a vertical, oval path of travel;

(2) a plurality of overlapping flexible handrail elements mounted on said path of travel defining means for movement about said vertical, oval path of travel, said plurality of handrail elements including a plurality of interleaved first and second handrail elements; and, (3) overlapping control means for controlling the amount of overlap between adjacent elements of said plurality of handrail elements, said overlapping control means comprising:

(a) cam means mounted inside of said path of travel defining means for controlling the position of cam follower means associated with said plurality of handrail elements, said cam means comprising a cam rail that converges toward said vertical, oval path of travel in an acceleration zone wherein the amount of handrail element overlap decreases and diverges from said vertical, oval path of travel in a deceleration zone wherein the amount of handrail element overlap increases;

(b) cam follower means associated with said plurality of handrail elements and projecting inwardly from said path of travel defining means so as to contact and be adjustably positioned by said cam means, said cam follower means comprising a plurality of arms, one arm rotatably attached at one end to each of said plurality of first handrail elements, and a plurality of rollers, one roller rotatably mounted on the opposite end of each of said arms, said rollers riding on said cam rail and acting to rotate their associated arms with respect to their associated handrail elements;

(c) flexible connecting means running between pairs of adjacent handrail elements and operatively connected to said cam follower means, such that the position of said cam follower means controls the length of said flexible connecting means running between pairs of adjacent handrail elements to thereby control the amount of handrail element overlap, said flexible connecting means comprising a plurality of first and second flexible members running between trios of adjacent handrail elements, each of said trios including two of said first handrail elements and one of said second handrail elements spaced between said two of said first handrail elements, one end of said first flexible member being affixed to one of said first handrail elements of said trios, and the other end of said first flexible member being affixed to said cam follower arm associated with said one of said first handrail elements, one end of said second flexible member being affixed to the same cam follower arm and the other end of said second flexible member being affixed to the other of said first handrail elements forming said trio, said flexible connecting means also including sheave means for coupling said first and second flexible members to said second handrail element of said trio in a manner such that when said arm associated with said one of said first handrail elements is rotated by its associated roller impinging on said cam rail, the length of said first and second flexible members running between said trio of handrail elements is varied whereby the amount of overlap between said trio of handrail elements is varied; and, (d) drive means for moving said plurality of overlapping elements about said vertical, oval path of travel.

2. The accelerating and decelerating handrail of claim 1 wherein the vertical, oval path of travel includes two sides lying generally parallel to one another, and curved end regions connecting said sides.

3. The accelerating and decelerating handrail of claim 2 wherein said curved end regions are semicircular constant speed zones wherein the amount of element overlap remains substantially constant.

4. The accelerating and decelerating handrail of claim 3 wherein:

said curved end regions include a boarding curved end region and a deboarding curved end region; and, said cam rail in said curved end regions includes a semicircular section, a substantial portion of said semicircular section in said boarding curved end region lying above the longitudinal, horizontal axis defined by said vertical, oval path of travel and a substantial portion of said semicircular section in said deboarding curved end region lying below said longitudinal, horizontal axis defined by said vertical, oval path of travel, said semicircular sections having a center that is coincident with the center of said curved end regions of said path of travel defining means.

5. The accelerating and decelerating handrail of claim 4 wherein said path of travel defining means includes handrail element support means associated with said path of travel defining means for supporting said plurality of overlapping handrail elements in said acceleration and deceleration zones.

6. The accelerating and decelerating handrail of claim 1 or 5 wherein said sheave means includes first and second sheaves rotatably attached to each of said plurality of second handrail elements, said first and second flexible members passing about said first and second sheaves, respectively.

7. The accelerating and decelerating handrail of claim 6 including:

(a) first and second axles associated with each of said plurality of second handrail elements;

(b) first mounting means associated with each of said plurality of second handrail elements including a fulcrum on which said first and second axles are mounted such that the longitudinal axis defined by said first and second axles lies internal to and transverse with said vertical, oval path of travel and such that said first and second axles can be oriented independent from the orientation of said overlapping handrail elements;

(c) first and second pairs of wheels associated with each of said plurality of second handrail elements, said wheels being mounted on the ends of said first and second axles, said first and second sheaves mounted on said first and second axles between said first and second pairs of wheels;

(d) a third axle associated with each of said plurality of first handrail elements;

(e) second mounting means associated with each of said plurality of first handrail elements for mounting said third axle such that the longitudinal axis defined by said third axle lies internal to and transverse with said vertical, oval path of travel; and, (f) a third pair of wheels associated with each of said plurality of first handrail elements, said wheels being mounted on each end of said third axle, said cam follower arm and said firt and second flexible members being attached to said third axle between said third pair of wheels.

8. The accelerating and decelerating handrail of claim 7 including handrail retaining means mounted adjacent the outer surfaces of said plurality of overlapping handrail elements for preventing movement of said handrail elements in a direction outwardly from said vertical, oval path of travel.

9. The accelerating and decelerating handrail of claim 8 wherein each of said plurality of handrail elements has a leading edge and a rearward overlapping edge and wherein a comb block is attached to said rearward overlapping edge and has an extension conforming to and in contact with the outer surface of an adjacent succeeding handrail element.

10. The accelerating and decelerating handrail of claim 9 wherein said outer surface of each of said plurality of handrail elements is comb-like and wherein said surface of said extension of said comb block contacting said outer surface of said elements is also comb-like and intermeshes with said comb-like outer surface of the handrail element it contacts.

11. The accelerating and decelerating handrail of claim 5 wherein outer and inner surfaces of said plurality of handrail elements include comb teeth means for intermeshing adjacent handrail elements of said plurality of handrail elements to prevent said adjacent handrail elements from separating from each other in a direction outward from said vertical, oval path of travel.

12. The accelerating and decelerating handrail of claim 11, wherein said plurality of handrail elements are mounted for sliding movement on said support means.

13. The accelerating and decelerating handrail of claim 12, wherein said support means laterally aligns said plurality of handrail elements and wherein said support means and said plurality of handrail elements form passenger gripping portions of said handrail.

* * * * *